US005762058A

United States Patent [19]

Cheng et al.

[11] Patent Number: 5,762,058

[45] Date of Patent: Jun. 9, 1998

[54] EXCITER FOR LUMINESCENT PROJECTILE

[76] Inventors: Richard T. Cheng; James S. Cheng, both of 1536 Duke Windsor Rd., Virginia Beach, Va. 23454

[21] Appl. No.: 681,552

[22] Filed: Jul. 23, 1996

Related U.S. Application Data

[60] Division of Ser. No. 630,434, Apr. 10, 1996, which is a continuation-in-part of Ser. No. 491,711, Jun. 19, 1995, abandoned.

[51] Int. Cl.[6] ..... F41B 11/00

[52] U.S. Cl. ..... 124/56; 124/1; 124/80; 124/83

[58] Field of Search ..... 124/1, 16, 21, 124/22, 26, 27, 56, 80, 83; 273/424, 425, 428, DIG. 24; 222/79; 446/219

[56] References Cited

U.S. PATENT DOCUMENTS

| | | | |
|---|---|---|---|
| 3,240,924 | 3/1966 | Darby | 362/112 |
| 3,822,393 | 7/1974 | Karpol | 315/241 P |
| 4,175,353 | 11/1979 | Pickett | 446/406 |
| 4,239,129 | 12/1980 | Esposito | 222/79 |
| 4,927,015 | 5/1990 | Jones | 206/315.9 |
| 4,930,776 | 6/1990 | Newcomb et al. | 273/58 B |
| 5,018,450 | 5/1991 | Smith | 102/513 |
| 5,080,359 | 1/1992 | Thill | 273/60 B |
| 5,228,697 | 7/1993 | Gulick et al. | 473/200 |
| 5,287,134 | 2/1994 | Cocca | 396/203 |
| 5,308,546 | 5/1994 | Hansen | 252/301.36 |
| 5,345,284 | 9/1994 | Tsuruta | 354/132 |
| 5,393,051 | 2/1995 | Rouffer | 273/29 B |
| 5,415,151 | 5/1995 | Fusi et al. | 124/56 |

*Primary Examiner*—John A. Ricci
*Attorney, Agent, or Firm*—Thedford I. Hitaffer

[57] ABSTRACT

Light emitting rigid, fracturable projectile-type marking ammunition is disclosed. The marking ammunition is in the form of a phosphorescent paintball. An exciter is adaptable for use with paintball guns to excite the phosphorescent paintball to emit light. The exciter couples to the muzzle of a paintball gun. The light emitting paintball provides a luminous trail when discharged from the paintball gun. A paintball according to the instant invention comprises a spherical pellet or capsule defining an interior chamber, and a filler contained in the chamber. In one embodiment, the capsule is impregnated with a phosphorescent material. In an alternative embodiment, a phosphorescent material is mixed with the filler. The phosphorescent material absorbs light when exposed to a light source, and after the light source is removed, emits light. A paintball being discharged from a paintball gun enters the exciter. Upon detecting the presence of a paintball, the exciter is triggered to produce a high intensity light. Light is absorbed by the phosphorescent material. After the light is removed, the phosphorescent material continues to emit light. Paintballs according to the instant invention discharged through the exciter provide a luminous trail and thus, may be used effectively in the dark.

46 Claims, 7 Drawing Sheets

EXCITER FOR LUMINESCENT PROJECTILE

This is a divisional of application Ser. No. 08/630,434, filed on Apr. 10, 1996 which is a continuation-in-part of application Ser. No. 08/491,711 filed Jun. 19, 1995 and now abandoned.

BACKGROUND OF THE INVENTION

1. Field of the Invention

The present invention relates generally to light emitting rigid, fracturable projectile-type marking ammunition and electronic strobe flash apparatus for air powered guns, and more specifically, to phosphorescent paintballs and an exciter adaptable for use with paintball guns for exciting the phosphorescent paintballs to emit light and thus, provide a luminous trail when discharged from the paintball gun.

2. Description of the Prior Art

Exercises or recreational activities involving paintball guns have become quite popular. Participants arranged in teams shoot paintballs at target participants of opposing teams. When a paintball strikes a target participant, it fractures and splatters a filler material, marking the target participant. The marked participant is disqualified from further participation in the exercise or activity.

Paintball guns known in the prior art are effective only when used in adequate lighting. In adequate lighting, a user can easily observe the impact of a paintball, and possibly the trace of its path, and adjust this aim accordingly. This does not hold true, however, when used in the dark because the user cannot trace the path of the paintball and hence, cannot determine with any amount of accuracy whether a targeted participant has been hit.

A paintball gun capable of discharging luminous paintballs overcomes the foregoing disadvantage of known paintball guns. Paintball pellets capable of emitting light would provide a luminous trail.

None of the paintball guns known in the prior art, taken either singly or in combination, are seen to describe the instant invention as claimed.

SUMMARY OF THE INVENTION

The present invention is generally a paintball gun adapter or accessory that discharges luminous paintballs. More particularly, the instant invention is to a paintball for use with an exciter for exciting the paintball to emit light and thus, provide a luminous trail when discharged from a paintball gun.

A paintball according to the instant invention comprises a spherical pellet or capsule defining an interior chamber, and a filler contained in the chamber. Either the capsule is impregnated with a phosphorescent material, or a phosphorescent is mixed with the filler. The phosphorescent material absorbs light when exposed to a light source, and after the light source is removed, emits light. The exciter couples to the muzzle of a paintball gun. A paintball being discharged from a paintball gun enters the exciter. Upon detecting the presence of a paintball, the exciter is triggered to produce a substantially instantaneous, high intensity light. Light is absorbed by the phosphorescent material. After the light is removed, the phosphorescent material continues to emit light. Paintballs according to the instant invention discharged through the exciter provide a luminous trail.

Accordingly, it is a principal object of the invention to provide a paintball which provides a luminous trail when discharged from a paintball gun.

It is another object to provide a paintball which emits light when exposed to, and subsequently removed from, a light source.

Another object is to provide a paintball comprising a phosphorescent material or some other photon absorbing and emitting material.

It is yet another object to provide phosphorescent paintballs which emit different color light and thus, provide different color trails when discharged from a paintball gun.

It is a further object to provide a paintball which emits a luminous trail when discharged from a paintball gun and, upon impact, fractures to splatter a luminous filler or paint therefrom.

Another object of the present invention is to provide an exciter for exciting paintballs carrying photon absorbing and emitting material so as to emit light and thus provide a luminous trail when discharged from a paintball gun.

It is an object that the exciter excite paintballs upon being discharged from a paintball gun.

It is yet another object that the exciter be adapted to couple to a variety of paintball gun muzzles.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
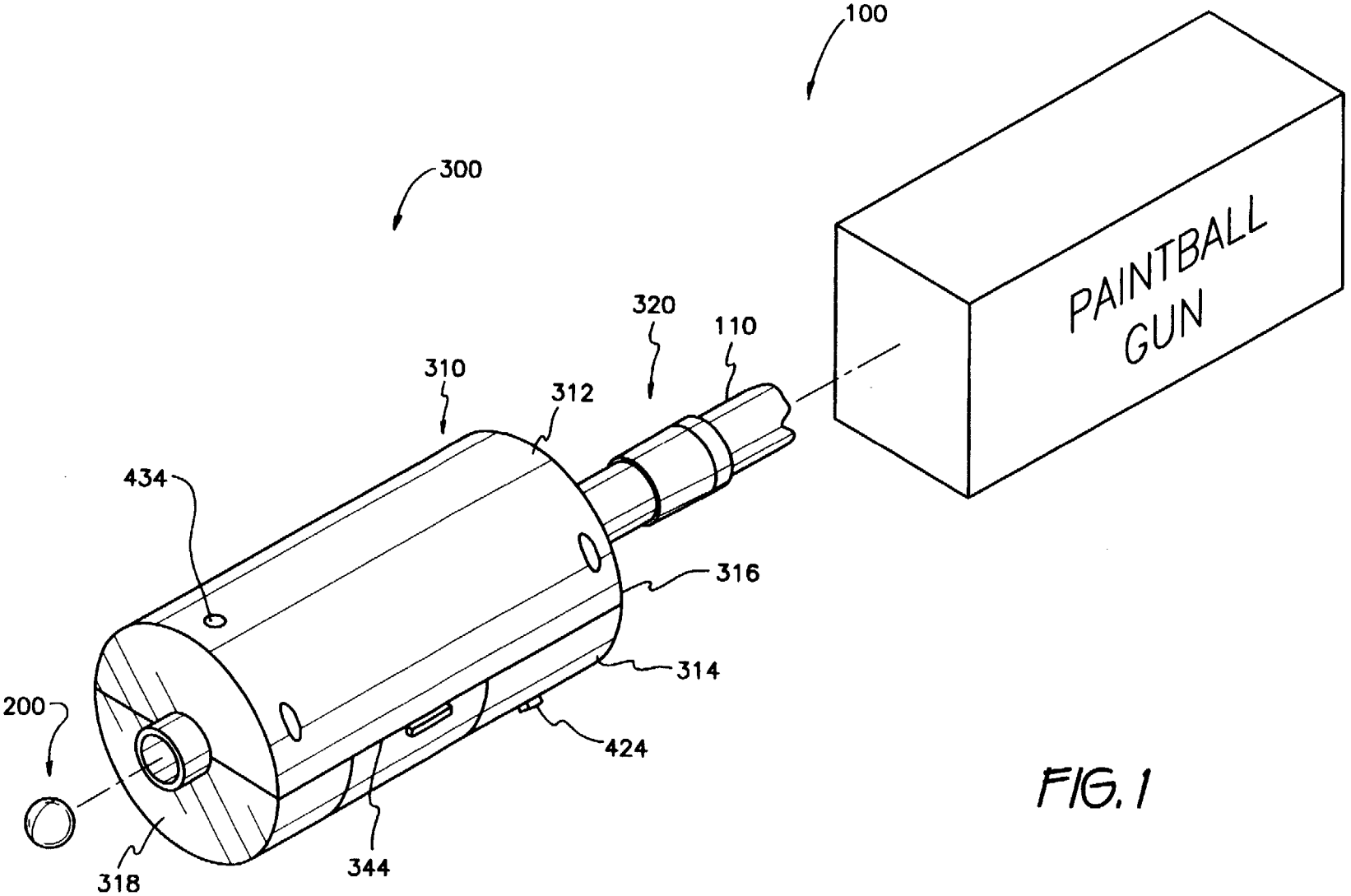
FIG. 1 is a partial perspective view and partial block diagram respectively showing a paintball and an exicter according to the instant invention, and a paintball gun used in combination therewith.

Now, with reference to the drawings, FIG. 1 shows a paintball gun 100 adaptable for use in discharging light emitting paintball projectiles 200, and more particularly, a phosphorescent paintball 200 and an exciter 300 for use in combination with a paintball gun 100. The exciter 300 excites the phosphorescent paintball 200 to emit light and provide a luminous trail when discharged from a paintball gun 100. The travel of a paintball 200 may be traced in a dark or poorly lit environment.

An exciter 300 is shown coupled to the muzzle 110 of a paintball gun 100. The exciter 300 comprises a cylindrical housing 310 formed of diametrically disposed halves 312 and 314. The housing 310 has a proximal end 316 and a distal end 318. An adapter 320 extending from the proximal end 316 of the housing 310 is configured to couple the exciter 300 to the muzzle 110 of the paintball gun 100.

Upon discharging a paintball 200 from the paintball gun 100, the paintball 200 exits through the muzzle 110 of the paintball gun 100, and then passes through the exciter 300 coupled to the muzzle 110. As the paintball 200 passes through the exciter 300, the paintball 200 is excited to emit light. The light emitting paintball 200 exiting the exciter 300 provides a luminous trail which permits the path of the paintball 200 to be traced.

Figure 2:
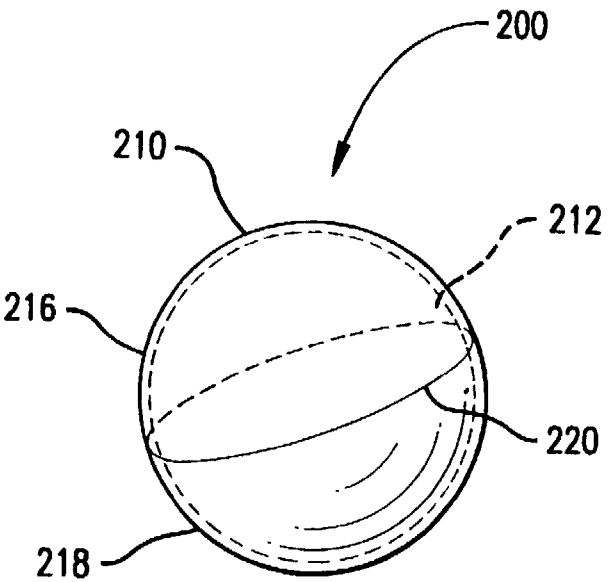
FIG. 2 is a perspective view of a paintball according to the instant invention.

A paintball 200, as shown in FIG. 2, comprises a spherical capsule 210 defining an interior chamber 212, and a filler (such as the filler in FIGS. 3 and 4) contained within the interior chamber 212. Typical capsules are approximately 1.496 centimeters (cm) in diameter.

The capsule 210 is formed of two half spheres 216 and 218. These hemispheres 216 and 218 are fused together along a sealing area defined by the adjoining hemisphere edges, thus providing a fusion band 220. As the hemispheres 216 and 218 are fused together, the filler is injected into the capsule 210 as it is being sealed. The capsule 210 is formed of a material impervious to the filler, and is of a thickness suitable to support the filler and withstand discharge, yet fracture upon impact. It is preferable that the thickness of the capsule 210 according to the instant invention ranges from 0.7 to 1.2 millimeters (mm).

It is preferable that the filler be washable. Moreover, the filler is preferably not injurious to a targeted participant (not shown). Furthermore, the filler is preferably biodegradable and safe to the environment.

Figure 3:
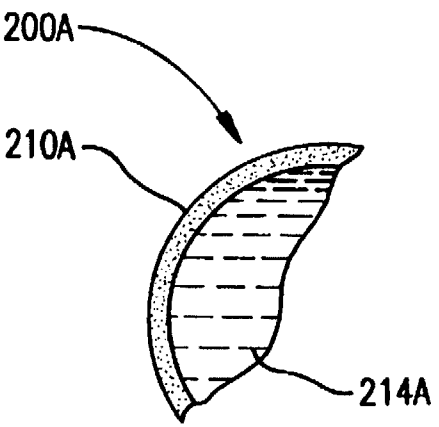
FIG. 3 is a partial section view of one embodiment of a paintball according to the instant invention.

FIG. 3 shows a paintball 200A comprising a capsule 210A impregnated with phosphorescent material. The capsule 210A preferably comprises 90–95 percent gelatin with 5–10 percent Zinc Sulfide (ZnS) doped with some photon absorbing or emitting material, such as Copper ($Cu^{++}$) ($ZnS.Cu^{++}$). The gelatin is preferably substantially transparent or translucent to permit maximum exposure of the phosphorescent material to incident radiation. Moreover, it is preferable that the thickness of this capsule 210A ranges between 0.8 to 1.2 millimeters (mm) to sufficiently excite the phosphorescent material. The thickness of the capsule 210A is also critical to provide sufficient structural integrity upon discharge yet fracture easily upon impact to splatter the filler 214A while causing minimum impact sting to a targeted participant (not shown). A transparent glycerin filler 214A is provided in this embodiment.

Figure 4:
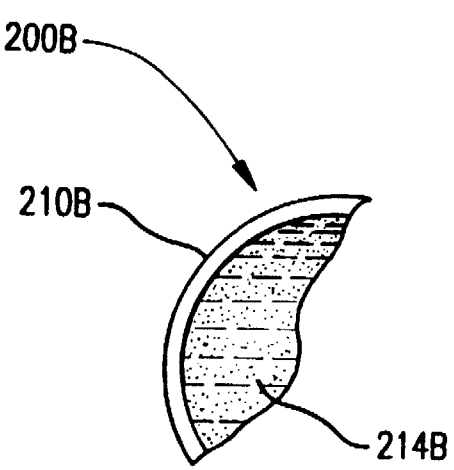
FIG. 4 is a partial section view of another embodiment of a paintball according to the instant invention.

An alternative paintball 200B is shown in FIG. 4. This embodiment is provided with a substantially transparent or translucent capsule 210B. Although the capsule 210B may be formed of any material sufficiently rigid to support a filler or solvent (arid more particularly a dispersing medium) 214B and withstand discharge yet be frangible upon impact, a gelatin capsule is preferred. In this embodiment, it is preferable that the capsule 210B have a thickness ranging from 0.7 to 0.9 millimeters (mm). The filler 214B in this embodiment is mixed with a surfactant (such as a commercial surface active agent) or dispersing agent and a phosphorescent material. Although the filler 214B preferably comprises a member of an organic group consisting of compounds referred to as triols, and in this case transparent glycerin or glycol, an alkyltriol, any solvent or family of solvents with properties of being insolvent with, and permitting the dispersing agent to disperse, the phosphorous material will suffice. The phosphorescent material is preferably comprised of 2–6 percent Zinc Sulfide (ZnS) doped with Copper ($Cu^{++}$) ($ZnS.Cu^{+-}$). Surfactants for use with $ZnS.Cu^{++}$ to obtain stable suspension include Alkaterge T-IV, Zelec NK Antistat, Amitex-E, Alkterge T, Tween 80, and Tween 20. To obtain best results, a ratio of 6:4 of surfactant to $ZnS.Cu^{++}$ by weight should be used.

In use, exposure of either paintball 200A or 200B to light excites the phosphorescent material to emit light. The phosphorescent material is best excited by ultraviolet rich light, and black light is twice as effective as incandescent light.

Light emitting paintballs 200A or 200B provide a luminous trail when discharged. The color of the trail varies in accordance with the composition of the paintball 200A or 200B. Various basic materials may be doped with various activators to emit different color lights. Basic materials include, but are not limited to, Zinc Zn, Sulfide S, Calcium Ca, and Strontium Sr. Activators may include, but are not limited to, Copper Cu, Manganese Mn, and Bismith Bi. Zinc Sulfide ZnS doped with Copper Cu ($ZnS.Cu^{++}$), as set forth above, emits a green trail. Zinc Sulfide ZnS doped with Calcium Ca and Manganese Mn (ZnS(Cu,Mn)) emits a yellow or orange trail. And Calcium and Strontium Sulfide (Ca,Sr)S doped with Bismith Bi ((Ca,Sr)S,Bi) emits a blue trail.

Referring back to FIG. 1, an exciter 300 for exciting phosphorescent paintballs is shown comprising a cylindrical housing 310 having diametrically disposed half sections 312 and 314, a proximal end 316, and a distal end 318.

Figure 6:
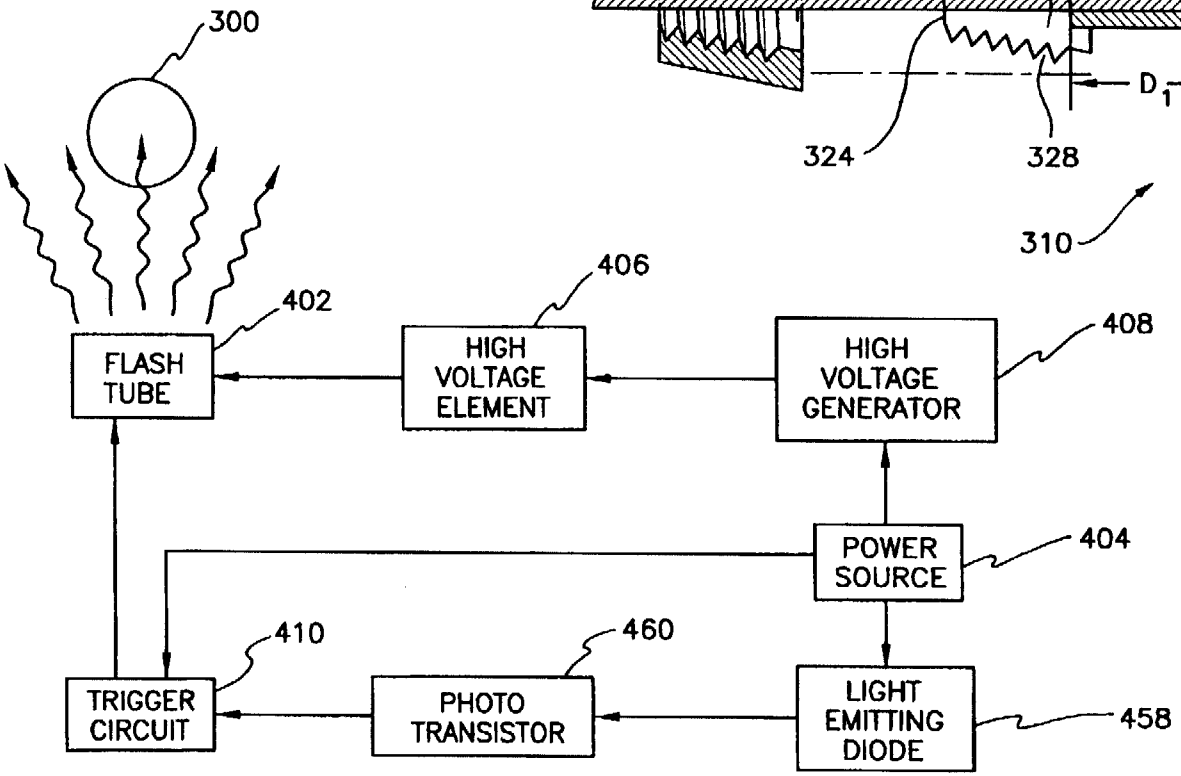
FIG. 6 is a section view of an adapter for coupling the exciter to the muzzle of a paintball gun.

An adapter 320 extends from the proximal end 316 of the housing 310. The adapter 320 is configured to couple the exciter 300 to the muzzle 110 of a paintball gun. As shown in FIG. 6, the adapter 320 comprises a tubular member 322 having a proximal end 324 and a distal end 326 respectively defining the proximal end and distal end of the adapter 320. The distal end 326 of the tubular member 322 is adjoined concentrically to the proximal end 316 of the housing 310, such as though some adhesion, fusion, or molding process. The proximal end 324 of the tubular member 322 is provided with tapered male threads 328, and has a plurality of longitudinal slits 330 therein extending substantially perpendicular to the tapered male threads 328.

A collar 332 having female threads 334 is matingly engagable with the beveled male threads 328 of the tubular member 322. As the collar 332 threadably engages the tubular member 322, the slits 330 are drawn closed. As the slits 330 are drawn closed, the proximal end 324 of the tubular member 322 frictionally engages the muzzle 110 of a paintball gun. Although plurality of slits 330 produce greater frictional contact, a single slit 330 may suffice.

As is clearly shown in the drawing, a concentric inner abutment surface 336 is provided within the tubular member 322. This abutment surface 336 limits the travel of the muzzle 110 within the tubular member 322 yet enables the muzzle 110 to extend a predetermined distance $D_1$ beyond the slits 330 to provide a substantially enclosed junction at the juncture adapter 320 and muzzle 110.

Referring back to FIG. 1, the exciter 300 further includes a switch 424, such as the toggle switch shown. The switch 424 enables and disables the exciter circuit 400 (shown in FIG. 7 and described hereinbelow). A neon indicator 434 is located on top of the housing 310 and at the distal end 318 of the housing 310. The neon indicator 434 is electrically connected to the switch 424 and illuminates when the switch 424 is closed, providing the user with an indication that the exciter circuit 400 is enabled.

Figure 5:
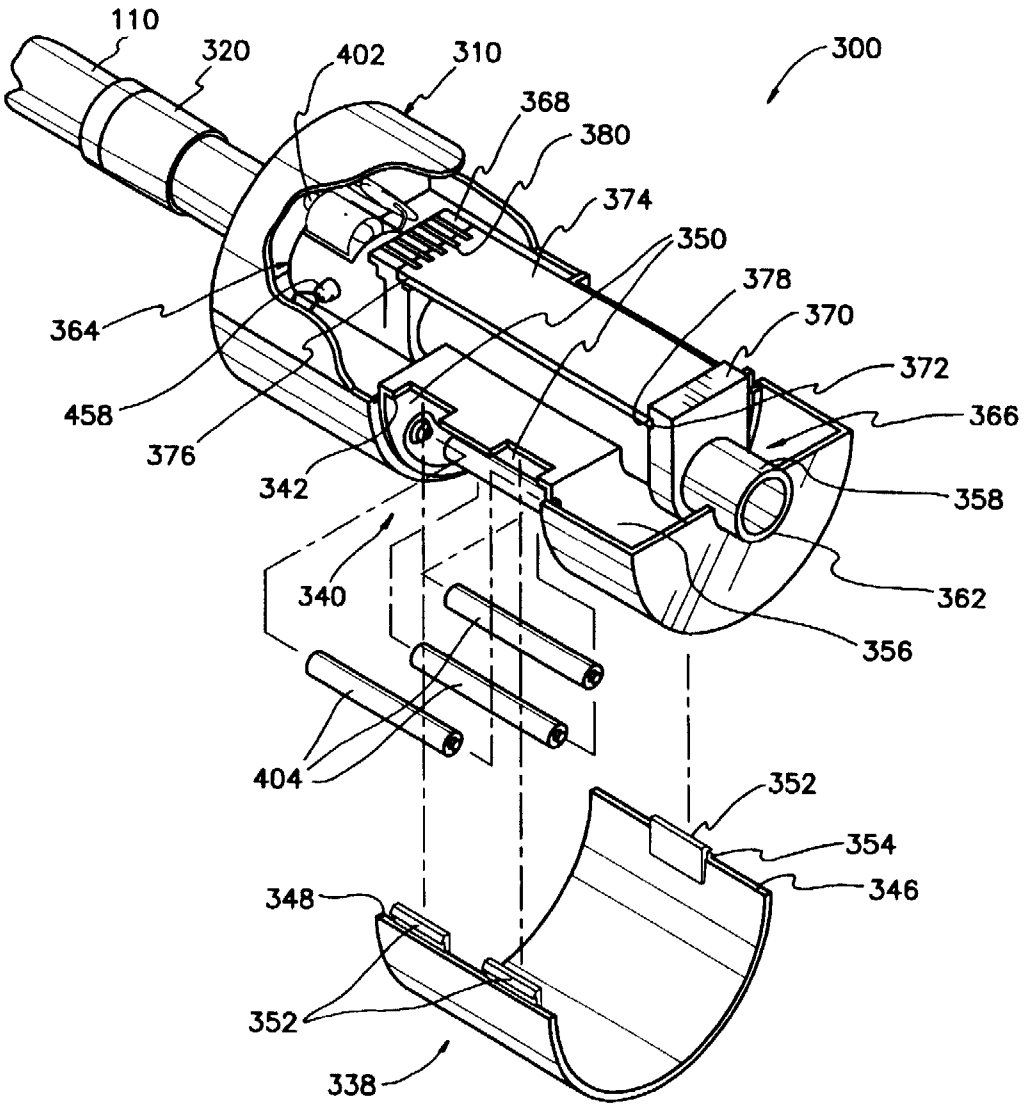
FIG. 5 is a partially exploded, partially cutaway perspective view of an exciter according to the instant invention.

Referring also to FIG. 5, the exciter 300 also comprises an arcuate shaped cover 338 which is structured and configured to conform substantially flush with, and define in part, the cylindrical housing 310. The cover 338 releasably engages the housing 310 and forms an access cover for a battery compartment 340 which is provided to contain a low voltage power source 404, such as the plurality of 1.5 VDC batteries shown. The power source 404 energizes the exciter circuit 400 when the switch 424 is closed.

As shown in the drawings, the housing 310 includes opposite sides 342 and 344. Likewise, the cover 338 includes opposite side edges 346 and 348. These side edges 346, 348 correspond to the opposite sides 342 and 344 of the housing 310. The side edges 346, 348 of the cover 338 abut the sides 344 and 342 of the housing 310 when the cover 338 engages the housing 310.

Openings 350 are formed along the sides 342 (however, not shown in one side 344) of the housing 310. Hooks 352 extending upwardly from the side edges 346 and 348 of the cover 338 are structured and configured to engage corresponding openings 350 along respective sides 344 and 342 of the housing 310. The arcuate structure of the cover 338 normally biases the hooks 352 outward within the corresponding openings 350 to engage the hooks 352 with the structure of the housing 310 forming the openings 350, thus latching the cover 338 to the housing 310. To unlatch the cover 338 from the housing 310, simply depress one or both sides of the cover 338 inward. This displaces the hooks 352 inward out of contact with the structure of the housing 310 forming the openings 350, and thus permits the cover 338 to be separated from the housing 310.

A nodule 354 is provided along one side 346 of the cover 338 proximate a hook 352 to assist the user in identifying the location of the hook 352 when the cover 338 is attached to the housing 310. Moreover, indicia, such as the term "Open", may be inscribed on the cover 338 proximate the nodule 354 to assist the user in identifying the function of the nodule 354.

Now, referring only to FIG. 5, the housing 310 of the exciter 300 defines an interior chamber 356. The interior chamber 356 contains the exciter circuit 400 (shown clearly in FIGS. 7 and 8) and has a tube 358 passing concentrically therethrough. The tube 358 has a proximal end 360 (shown in FIG. 6) and a distal end 362, and is at least partially transparent to permit light to pass therethrough. The proximal end 360 of the tube 358 is preferably attached to the proximal end 316 of the housing 310, and the distal end 362 of the tube 358 is preferably attached to the distal end 318 of the housing 310, thus maintaining the tube 358 in a fixed position within the chamber 356.

The tube 358 has a head 364 attached to its proximal end 360 and a support member 366 attached to its distal end 362. The head 364 comprises a six pin female connector 368, and supports an infrared light emitting diode 456 (shown in FIGS. 9 through 12), a photo transistor 458, and a pair of diametrically disposed flash tubes 402 (the second of which is clearly shown in FIGS. 9 through 12) in close proximity to the tube 358. The support member 366 includes an upper extension 370 having lateral groove 372 therein.

A circuit board 374 extending longitudinally within the chamber 356 has a proximal end 376 and a distal end 378. A six pin male connector 380 is integral with the proximal end 376 of the circuit board 374. This connector 380 is matingly engageable with the female connector 368 on the head 364 and thus, supports the proximal end 376 of the circuit board 374. The distal end 378 of the circuit board 374 is frictionally engageable with the lateral groove 372 in the support member 366. This supports the distal end 378 of the circuit board 374.

Figure 7:
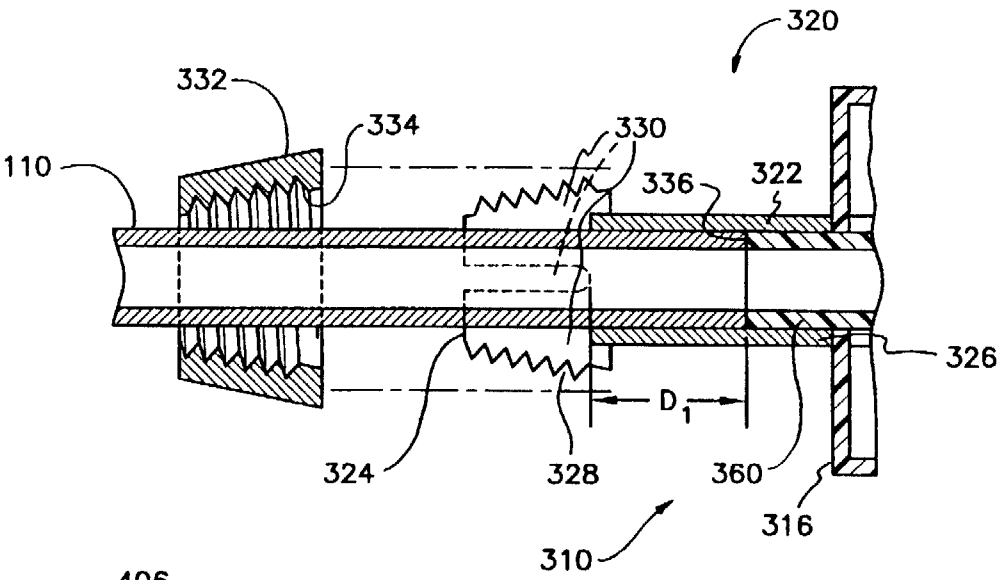
FIG. 7 is a diagramatic representation of an exciter electrical circuit.
Figure 8:
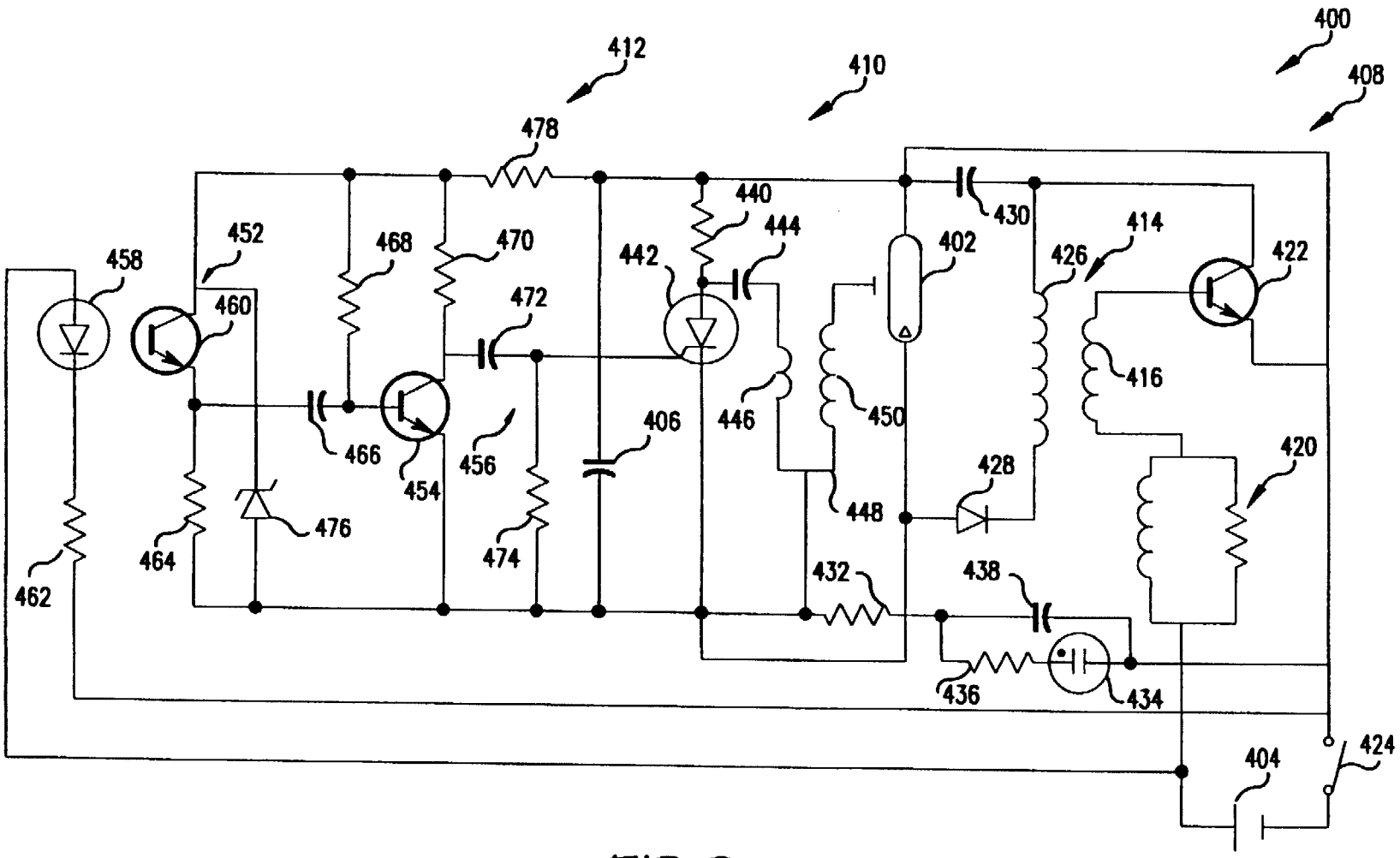
FIG. 8 is a schematic representation of an exciter electrical circuit.
Figure 9:
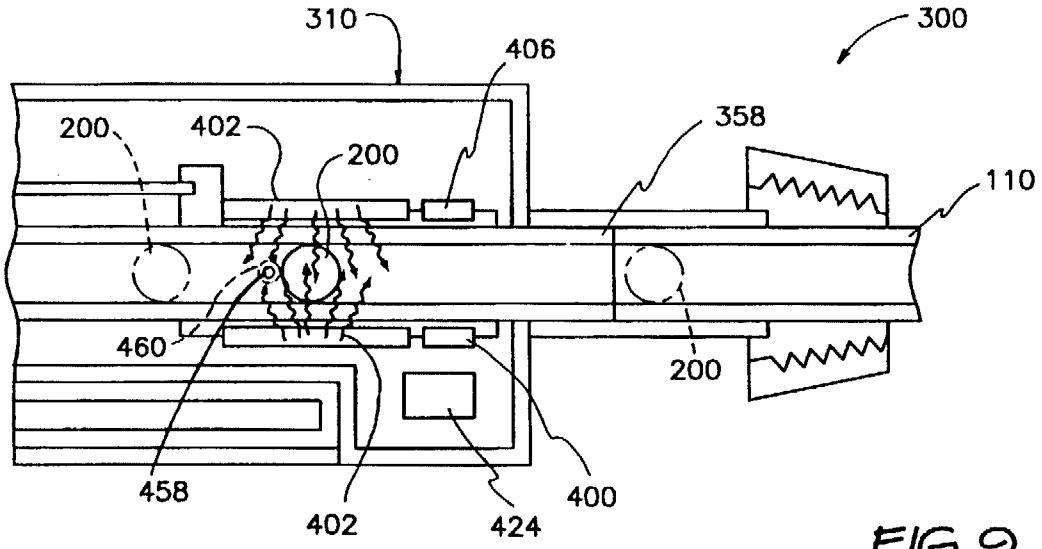
FIG. 9 is a diagramatic representation of a paintball being discharged through the exciter.
Figure 12:
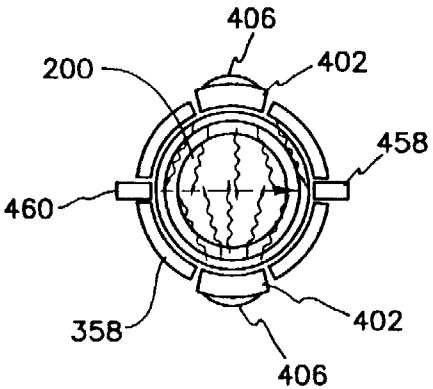
FIG. 12 is a diagramatic representation of a paintball absorbing light from the strobe flash tubes subsequent to the photo transistor of the emitter-detector pair detecting an interruption in light emitted from the infrared light emitting diode.
Figure 11:
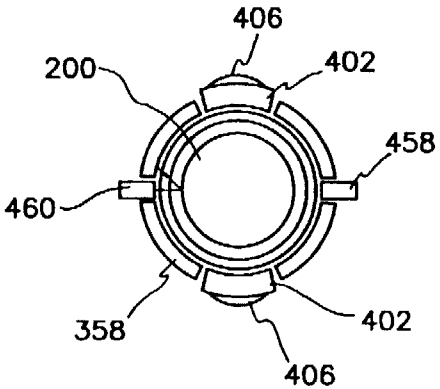
FIG. 11 is a diagramatic representation of a paintball interrupting an infrared beam emitted from the infrared light emitting diode of the emitter-detector pair.
Figure 10:
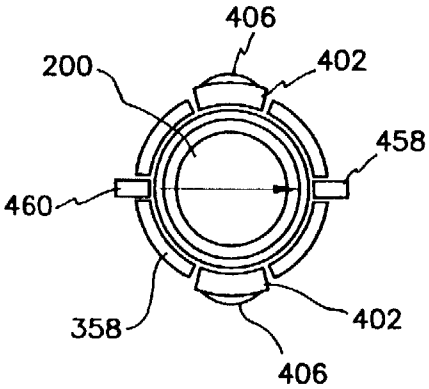
FIG. 10 is a diagramatic representation of a paintball approaching the emitter-detector pair.

With reference to FIGS. 7 and 8, an exciter circuit 400 includes a pair of energizable flash tubes 402 arranged to project light in a direction interiorly of the exciter tube 358 (as is shown in FIGS. 10 through 12), a low voltage power source 404 for providing charging energy, a high voltage storage element or capacitor 406 coupled to the flash tubes 402, a high voltage generator circuit 408 for providing charging current from the power source 404 to the high voltage capacitor 406 until the capacitor 406 is charged to a predetermined voltage, a trigger circuit 410 for generating a trigger voltage to set off the flash tubes 402, and a detector circuit 412 for controlling the trigger circuit 410.

A high voltage generator circuit 408 similar to that of the instant invention is set forth in U.S. Pat. No. 3,822,393, issued Jul. 2, 1974 to Zvi Y. Karpol. The high voltage generator circuit 408 comprises a step up transformer 414 having one terminal of its primary winding 416 coupled to the positive side of the low voltage power source 404 through an RL network 420, and the other terminal of its secondary winding 416 is coupled to the base of an oscillator transistor 422. The emitter of the oscillator transistor 422 is connected to the negative side of the power source 404 through a switch 424. The collector of the oscillator transistor 422 is connected to one terminal of the secondary winding 426 of the step up transformer 414, and of which the other terminal is coupled to the cathode of the flash tube 402 through a rectifier diode 428. A high frequency coupling capacitor 430 has one terminal connected to the junction of the terminal of the secondary winding 426 and the collector of the oscillator transistor 422, and the other terminal connected to a terminal of the high voltage capacitor 406. The other terminal of the high voltage capacitor 406 is connected to the junction of the emitter of the oscillator transistor 422 and switch 424 through a bleeder resistor 432, a neon indicator 434 and current limiting resistor 436, and a filter capacitor 438. The high voltage generator 408 converts the 1.5 VDC power source 404 to approximately 250 VDC, which is stored in the high voltage capacitor 406.

The trigger circuit 410 for discharging the high voltage capacitor 406 is similar to that shown and described in U.S. Pat. No. 5,287,134, issued Feb. 15, 1994 to J. David Cocca. The trigger circuit 410 includes the series combination of a resistor 440 and a discharge trigger SCR 442 connected across the high voltage capacitor 406. The junction between the resistor 440 and the anode of the discharge trigger SCR 442 is connected to one terminal of a coupling capacitor 444, the other terminal of which is connected to one end of the primary winding 446 of a trigger transformer 448. The other terminal of the primary winding 446 of the trigger transformer 448 is connected to the cathode of the discharge trigger SCR 442. The secondary winding 450 of trigger transformer 448 is connected to the gate of the flash tube 402. The anode terminal of the flash tube 402 is connected to the junction of the resistor 440 connected to the anode of the discharge trigger SCR 442 and the high voltage capacitor 406, and the cathode of flash tube 402 is connected to the cathode of the discharge trigger SCR 442 at the junction of the rectifier diode 428. The flash tube 402 is triggered into conduction by a 3000 VDC signal produced by the trigger transformer 448 at the gate of the flash tube 402 and emits a flash of light during the discharge of the high voltage capacitor 406 in response to a flash trigger signal provided from the detector circuit 412.

The detector circuit 412 comprises an emitter-detector pair 452, a switching amplifier 454, and a RC network 456. The emitter-detector pair 452 is comprised of a light emitting diode 458 and the photo transistor 460. The anode of the diode 458 is connected to the positive side of the low voltage power source 404. A current limiting resistor 462 couples the cathode of the diode 458 to the negative side of the power source 404 through the switch 424. The open base of the photo transistor 460 is arranged to detect light emitted from the diode 458. A resistor 464 is connected to the emitter of the photo transistor 460. A coupling capacitor 466 has one terminal connected to the junction of the emitter of the photo transistor 460 and the emitter resistor 464, and the other terminal is connected to the base of the switching amplifier 454. A pull up resistor 468 is connected at the junction of the coupling capacitor 466 and the base of the switching amplifier 454. A resistor 470 is connected the collector of the switching amplifier 454, and a coupling capacitor 472 has one terminal connected to the junction of the collector of the switching amplifier 454 and the collector resistor 470, the other terminal of which is connected to the gate of the discharge SCR 442. A pull down resistor 474 is connected at the junction of the coupling capacitor 472 and the gate of the discharge trigger SCR 442. The coupling capacitor 472 and the pull down resistor 474 form an RC network which provides a desired time delay for reaching the gate voltage of the discharge trigger SCR 442. Since a paintball 100 (shown in FIG. 2 above) travels at a rate of 80 to 100 meters (m) per second leaving the muzzle 110, a delay of 0.010 to 0.015 milliseconds (ms) is required before the trigger circuit 410 sets off the flash tubes 402. A Zener diode 476 connected to the collector of the photo transistor 460 regulates the voltage across the photo transistor 460, switching amplifier 454, and the gate of the discharge trigger SCR 442 to 9 VDC, and a resistor 478 connecting the collector resistor 470 of the switching amplifier 454 and the anode resistor 440 of the discharge trigger SCR 442 is a voltage control resistor for the low voltage supply 404.

As shown in FIGS. 9 through 12, and further referring to FIGS. 7 and 8, in operation, the exciter 300 is coupled to the muzzle 110 of a paintball gun. The exciter 300 is energized by closing the switch 424. Upon closing the switch 424, the infrared light emitting diode 458 emits an infrared beam across the tube 358 passing through the exciter housing 310. The presence of the infrared beam is detected by the photo transistor 460, as is shown in FIG. 10. As a phosphorescent paintball 200 is discharged from the paintball gun 100, it enters the tube 358 passing through the housing 310 of the exciter 300. As the paintball 200 passes between the diode 458 and the photo transistor 460, the infrared beam emitted from the infrared diode 458 is interrupted, as is shown in FIG. 11. The photo transistor 460 detects the interruption in the infrared beam. The interruption in the infrared beam is detected by the photo transistor 460, which produces a pulse at its output. The output of the photo transistor 460 is amplified by the switching amplifier 454. The output of the switching amplifier 454 triggers the discharge trigger SCR 442. The RC network 456 provides a desired time delay for triggering the discharge trigger SCR 442 to compensate for the travel of the paintball 200 and the distance between the flash tubes 402 and the emitter detector pair 452. When the discharge trigger SCR 442 is triggered, the high voltage capacitor 406 discharges through the trigger transformer, stepping up the 250 VDC stored therein to produce a 3000 VDC signal at the electrode of the flash tube 402, causing the flash tube 402 to flash an ultra violet rich light, as shown in FIG. 12 When the strobe lamp 402 flashes, the paintball 200 is excited, that is, the phosphorescent material in the paintball 200 absorbs the light emitted from the flash tube 402. Subsequent to this exposure, the paintball 200 continues to emit light, providing a luminous trail.

Figure 13:
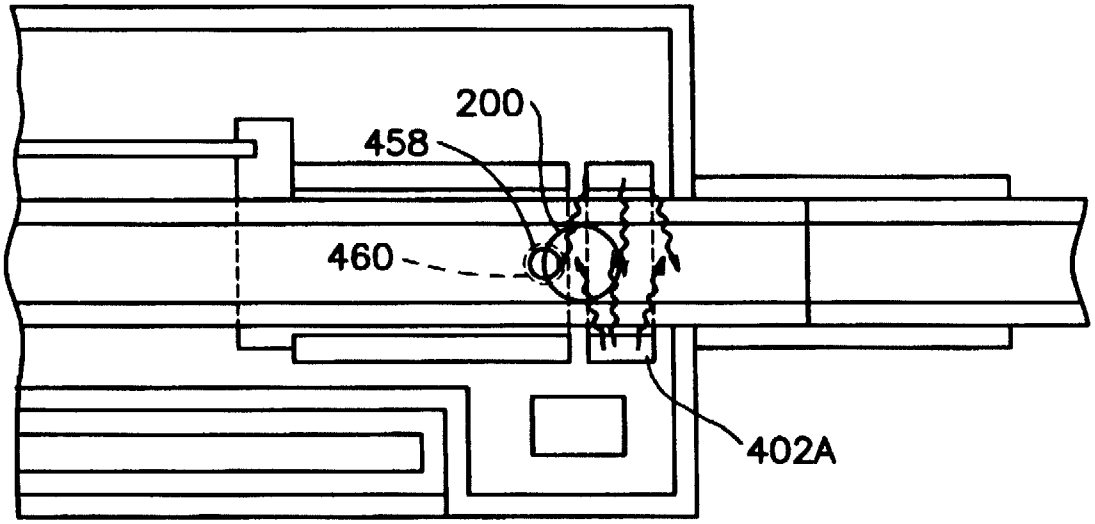
FIG. 13 is a diagramatic representation of an alternative exciter employing a flash ring leading the emitter-detector pair.

FIG. 13 shows an alternative arrangement wherein a flash ring 402A is employed. The flash ring 402A leads the diode 458 and the photo transistor 460. As the leading edge of a paintball 200 being discharged interrupts the signal from the light emitting diode 458, the trigger circuit 410 (shown in FIGS. 7 and 8) triggers the flash ring 402A to emit and flash of ultraviolet rich light which is absorbed by the phosphorous material in the paintball 200. A flash ring 402A may irradiate the paintball with more light, it may be more costly than a conventional flash tube 402. It should be noted that the arrangement of either the flash tube 402, a plurality of flash tubes 402, or the flash ring 402A may lead or lag the emitter-detector pair 452, and may be arranged adjacent to one another or may be spaced apart.

It is to be further understood that the present invention is not limited to the sole embodiment described above, but encompasses any and all embodiments within the scope of the following claims.

We claim:

1. An exciter energized by a power source and for use with a paintball gun for exciting paintballs to emit light, said exciter comprising:

a tube;

a coupling for coupling said tube to the muzzle of a paintball gun so as to substantially coalign with the muzzle of the paintball gun; and a light source supported adjacent said tube, said light source being arranged to emit light into said tube.

2. An exciter according to claim 1, further comprising:

a detector;

a high voltage generator;

a high voltage storage element connected to said high voltage generator; and a trigger connected to said high voltage storage element and said light source, said light source comprising a flash bulb, said trigger further being connected to said detector and being controlled by said detector to set off said flash bulb.

3. An exciter according to claim 2, wherein said tube has a substantially transparent tube region.

4. An exciter according to claim 3, wherein said detector comprises:

a light source and a light sensor, said light source being arranged to emit light through said substantially transparent region of said tube, said light sensor being arranged to alternatively detect light emitted from said light source and detect an interruption in light emitted from said light source when a paintball passes between said light source and said light sensor.

5. An exciter according to claim 2, wherein said high voltage generator includes a DC to DC converter for converting voltage from the power source to a high voltage source.

6. An exciter according the claim 2, wherein said high voltage storage element includes a high voltage capacitor.

7. An exciter according the claim 2, wherein said flash bulb comprises a flash tube.

8. An exciter according the claim 2, wherein said flash bulb comprises a flash ring.

9. An exciter energized by a low voltage power source and for use with a paintball gun for exciting photon absorbing paintballs discharged from the paintball gun, said exciter comprising:

a housing;

a tube passing through said housing, said tube having a substantially transparent region;

a coupling for coupling said tube to the muzzle of a paintball gun and substantially in coalignment with the muzzle of the paintball gun; and an exciter circuit, comprising:

a detector comprising a light source and a light sensor, said light source being arranged to emit light through said substantially transparent region of said tube, said light sensor being arranged to alternatively detect light emitted from said light source and detect an interruption in light emitted from said light source when a paintball passes between said light source and said light sensor;

a high voltage generator connected to the low voltage power source and being configured to convert voltage from the low voltage power source to high voltage;

a high voltage storage element connected to said high voltage generator;

a flash bulb connected to said high voltage storage element, said flash bulb being supported adjacent said substantially transparent region of said tube; and a trigger connected to said high voltage storage element and said flash bulb, said trigger further being connected to said detector and being controlled by said detector to set off said flash bulb when said light sensor detects an interruption in light from said light sensor.

10. An exciter according the claim 9, wherein said flash bulb comprises a flash tube.

11. An exciter according the claim 9, wherein said flash bulb comprises a flash ring.

12. A paintball gun for use with a power source to discharge paintballs, said paintball gun comprising:

a muzzle;

means for propelling a projectile for ejecting the projectile from said muzzle;

an exciter energized by the power source, said exciter comprising:

a tube;

a light source supported adjacent said tube, said light source being arranged to emit light into said tube; and a coupling for coupling said tube to said muzzle so as to substantially coalign with said muzzle.

13. An exciter according the claim 12, wherein said flash bulb comprises a flash tube.

14. An exciter according the claim 12, wherein said flash bulb comprises a flash ring.

15. A paintball gun for use with a power source to discharge luminous paintballs, said paintball gun comprising:

a muzzle;

means for propelling a projectile for ejecting the projectile from said muzzle;

an exciter comprising:

a housing;

a tube passing through said housing, said tube having a substantially transparent region; and an exciter circuit, comprising:

a detector comprising a light source and a light sensor, said light source being arranged to emit light through said substantially transparent region of said tube, said light sensor being arranged to alternatively detect light emitted from said light source and detect an interruption in light emitted from said light source when a paintball passes between said light source and said light sensor;

a high voltage generator connected to a low voltage power source and being configured to convert voltage from a low voltage power source to high voltage;

a high voltage storage element connected to said high voltage generator;

a flash bulb connected to said high voltage storage element, said flash bulb being supported adjacent said substantially transparent region of said tube; and a trigger connected to said high voltage storage element and said flash bulb, said trigger further being connected to said detector and being controlled by said detector to set off said flash bulb when said light sensor detects an interruption in light from said light source; and a coupling for coupling said tube to said muzzle and substantially in coalignment with said muzzle.

16. An exciter according the claim 15, wherein said flash bulb comprises a flash tube.

17. An exciter according the claim 15, wherein said flash bulb comprises a flash ring.

18. A paintball gun for use with a power source adapted to excite paintballs to emit light, said paintball gun comprising:

a muzzle;

means for propelling a projectile for ejecting the projectile from said muzzle; and an exciter coupled to said muzzle, said exciter being energizable by the power source, said exciter comprising:

a light source, said light source being arranged so as to emit light toward a paintball upon discharging the paintball through said muzzle;

a tube, said light source being supported adjacent said tube, said light source being arranged to emit light into said tube; and a coupling for coupling said tube to said muzzle of said paintball gun so as to substantially coalign with said muzzle of said paintball gun.

19. A paintball gun according to claim 18, wherein said exciter further comprises an exciter circuit comprising:

a detector;

a high voltage generator;

a high voltage storage element connected to said high voltage generator; and a trigger connected to said high voltage storage element and said light source, said light source comprising a flash bulb, said trigger further being connected to said detector and being controlled by said detector to set off said flash bulb.

20. A paintball gun according to claim 19, wherein said detector comprises:

a light source and a light sensor, said light source being arranged to emit light through said substantially transparent region of said tube, said light sensor being arranged to alternatively detect light emitted from said light source and detect an interruption in light emitted from said light when a paintball passes between said light source and said light sensor.

21. A paintball gun according to claim 19, wherein the high voltage generator includes a DC to DC converter for converting voltage from the power source to a high voltage source.

22. A paintball gun according the claim 19, wherein said high voltage storage element includes a high voltage capacitor.

23. A paintball gun according the claim 19, wherein said flash bulb comprises a flash tube.

24. A paintball gun according the claim 19, wherein said flash bulb comprises a flash ring.

25. A paintball gun according to claim 18, wherein said tube has a substantially transparent tube region.

26. An exciter energizable by a power source and for use with a paintball gun for exciting paintballs to emit light, said exciter comprising:

a tube removably attachable to the muzzle of a paintball gun so as to substantially coalign with the muzzle of the paintball gun;

a light source supported adjacent said tube, said light source being arranged to emit light into said tube upon energizing said light source and discharging a paintball through said tube;

a detector comprising an emitter-detector pair cooperatively arranged and configured to detect the passage of a paintball therebetween upon enabling said emitter-detector pair and discharging the paintball through said tube; and a trigger controllable by said detector to energize said light source.

27. A paintball gun according to claim 26, further comprising:

a high voltage generator; and a high voltage storage element for alternatively storing voltage generated by said high voltage generator, upon enabling said high voltage generator, and discharging the voltage across said light source to energize said light source upon activating said trigger.

28. A paintball gun according to claim 27, wherein said high voltage generator includes a DC to DC converter for converting voltage from the power source to a high voltage source.

29. A paintball gun according to claim 27, wherein said high voltage storage element includes a high voltage capacitor.

30. A paintball gun according the claim 26, wherein said light source comprises a flash tube.

31. A paintball gun according the claim 26, wherein said light source comprises a flash ring.

32. A paintball gun according the claim 26, further including a housing through which said tube passes, and in which said light source is contained.

33. A paintball gun for use with a power source to discharge luminescent paintballs, said paintball gun comprising:

a muzzle;

means for propelling a projectile for ejecting the projectile from said muzzle; and an exciter energizable by the power source, said exciter comprising:

a tube releasably coupled to said muzzle; and a light source supported adjacent said tube, said light source being arranged to emit light into said tube upon energizing said light source and discharging a paintball through said tube.

34. A paintball gun according to claim 33, further comprising:

a detector; and a trigger controllable by said detector to energize said light source.

35. A paintball gun according to claim 34, wherein said detector comprises an emitter-detector pair cooperatively arranged and configured to detect the passage of a paintball therebetween upon enabling said emitter-detector pair and discharging the paintball through said tube.

36. A paintball gun according to claim 35, further comprising:

a high voltage generator; and a high voltage storage element for alternatively storing voltage generated by said high voltage generator, upon enabling said high voltage generator, and discharging the voltage across said light source to energize said light source upon activating said trigger.

37. A paintball gun according to claim 36, wherein said high voltage generator includes a DC to DC converter for converting voltage from the power source to a high voltage source.

38. A paintball gun according to claim 36, wherein said high voltage storage element includes a high voltage capacitor.

39. A paintball gun according to claim 33, wherein said light source comprises a flash tube.

40. A paintball gun according to claim 33, wherein said light source comprises a flash ring.

41. A paintball gun for use with a power source in exciting luminescent paintballs, said paintball gun comprising:

a muzzle;

means for propelling a projectile for ejecting the projectile from said muzzle; and an exciter removably coupled to said muzzle, said exciter being energizable by the power source, said exciter comprising:

a light source, said light source being arranged so as to emit light towards a paintball upon energizing said light source and discharging the paintball through said exciter.

42. A paintball gun for use with a power source in exciting luminescent paintballs, said paintball gun comprising:

a muzzle;

means for propelling a projectile for ejecting the projectile from said muzzle;

an exciter, said exciter being energizable by the power source, said exciter comprising:

a tube;

a light source supported adjacent said tube, said light source being arranged to emit light into said tube upon energizing said light source and further upon discharging a paintball through said tube; and a coupling for removably coupling said tube to said muzzle.

43. A paintball gun according to claim 42, wherein said tube has a substantially transparent tube region.

44. A paintball gun for use with a power source in exciting luminescent paintballs, said paintball gun comprising:

a muzzle;

means for propelling a projectile for ejecting the projectile from said muzzle; and an exciter removably coupled to said muzzle, said exciter being energizable by the power source, said exciter comprising:

a detector;

a high voltage generator;

a high voltage storage element connected to said high voltage generator;

a trigger connected to said high voltage storage element and said detector; and a flash bulb, said trigger further being connected to said flash bulb, said flash bulb being arranged so as to emit light towards a paintball upon activating said trigger by said detector and discharging a paintball through said exciter.

45. A paintball gun according to claim 44, wherein said detector comprises a light source and a light sensor, said light source of said detector being arranged to emit light through said substantially transparent region of said tube upon being energized; said light sensor being arranged to alternatively detect light emitted from said light source of said detector and detect an interruption in light emitted from said light source of said detector upon enabling said light source of said detector and said light sensor and further upon discharging a paintball between said light source of said detector and said light sensor.

46. A paintball gun comprising:

a barrel having a forward, discharging end;

means for propelling a projectile for ejecting the projectile from said muzzle; and a flash ring surrounding said forward, discharging end of said barrel.

* * * * *